United States Patent [19]

Evertz et al.

[11] Patent Number: 4,555,094

[45] Date of Patent: Nov. 26, 1985

[54] PROCESS FOR THE REPAIR OF SLIDE PLATES

[75] Inventors: Egon Evertz, Vorlander Strasse, 5650 Solingen; Jorg Pirdzun, Mulheim, both of Fed. Rep. of Germany

[73] Assignee: Egon Evertz, Solingen, Fed. Rep. of Germany

[21] Appl. No.: 569,854

[22] Filed: Jan. 11, 1984

[51] Int. Cl.[4] ..... C21C 5/46

[52] U.S. Cl. ..... 266/45; 266/284; 266/281

[58] Field of Search ..... 266/45, 281, 44, 236, 266/286, 287, 280, 284; 222/599, 591, 600, 601, 597; 264/30

[56] References Cited

U.S. PATENT DOCUMENTS 4,182,466 1/1980 Fehling et al. ..... 222/600
4,386,765 6/1983 Roberts et al. ..... 266/236

FOREIGN PATENT DOCUMENTS 2060842 5/1981 United Kingdom ..... 222/600

*Primary Examiner*—L. Dewayne Rutledge
*Assistant Examiner*—S. Kastler
*Attorney, Agent, or Firm*—Holman & Stern

[57] ABSTRACT

The invention relates to a method for repairing slide plates of metallurgical containers. These types of slide plates consist of refractory material and have a passage opening for the discharge of the liquid metal, which is usually steel. Owing to corrosion and radial cracks, which orginate at the passage opening, these slide plates 5 become worn after a lengthy operating time. In order to be able to further use them to a large extent, the invention provides a bore, in the area of the opening, extending as far as the edge of the rim 6 of the slide plate, while the remaining refractory material is retained. Into this bore there is poured a refractory casting mass, the grain structure of which has a particular relation to the pore size of the retained refractory material. The essential fact is that the solid bodies of the refractory casting mass are predominantly smaller than the open pores, cut by means of the boring process, of the retained refractory material and can penetrate into the pores. This produces anchoring, which reliably prevents the consolidated refractory casting mass from subsequently peeling off the retained refractory material.

10 Claims, 2 Drawing Figures

PROCESS FOR THE REPAIR OF SLIDE PLATES

DESCRIPTION

Figure 1:
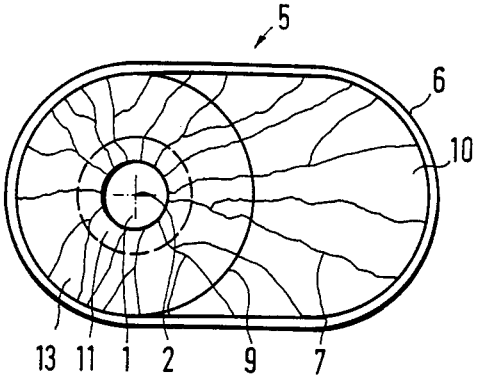

The invention relates to a method for repairing lower and upper slide plates of closures in metallurgical containers, in particular in casting ladles and intermediate containers for continuous casting, the slide plate optionally releasing the stream of liquid metal by means of a passage opening or interrupting it by means of a closed section, according to its position, and undergoing damage, in particular erosion and radial cracks, originating at its passage opening, in which method a bore is made in the area of the opening of the slide plate concentrically with respect to its passage opening and when the passage opening is released, a refractory casting mass is poured into the bore and is solidified therein.

In a known method of this type according to DE-OS No. 31 24 359, a casting or stamping mass with needles of rust-free steel are used to prevent new cracking of the repair mass introduced, owing to improved elasticity of the latter. Basically slide plates need displacing in a straight line or rotating for optionally opening or controlling the outflow of metals from metallurgical containers. During operation these types of slide plates are subjected to considerable thermal and chemical stress by the liquid metal. Therefore, after a certain operating time the opening becomes worn, as a result of which an opening at another position on the slide plate is then frequently used for further operation. Wear, caused by erosion and corrosion, occurs particularly where the stream of liquid metal also has an additional mechanical effect on the refractory material. This is normally the case on the periphery of an opening, which is in the direction of the shifting path, along which path the column of liquid metal rests on the slide plate, when the latter is changed over to its closing position. If a slide plate with its opening is movable in both directions of displacement, wear usually occurs at two peripheral places on the opening, opposite each other. In addition to this damage caused by material erosion, there are further instances of damage caused by the formation of cracks in the material of the slide plates. These cracks extend approximately radially from the openings and some of them even continue until they are close to the outer edge of the slide plate. Provided that the cohesion of the material is not interrupted, these types of cracks themselves do not, however, result in the slide plate becoming unusable. Erosion of the opening does, however, make it necessary to exchange the slide plate, which incurs considerable cost.

In order to decrease the mentioned cost, after dismantling, the slide plates are, therefore, often repaired with an insert sleeve made of refractory material, which is inserted into the opening in the slide plate, for which purpose the opening is often enlarged concentrically to a limited degree. Although a clearly defined new opening is obtained inside the slide plate, after a displacement movement of the slide plate the column of liquid metal also has an effect, at least temporarily, on the outer edge of the sleeve, this outer edge in turn being connected to the adjoining network of tension cracks. Liquid material can, therefore, undesiredly escape at this point and finally make the slide plate totally unusable.

The improvement of the area of the slide plate, which has become unusable, using refractory material is hindered by the fundamental difficulty that the latter can no longer adhere to the retained substance of the slide plate, so that in the end it peels off the retained material again.

The object of the invention is to repair a slide plate of the described type in such a way that no liquid metal can penetrate into the radial cracks present in the retained material. In particular it is to be ensured that material introduced into the damaged area of the slide plate cannot become detached again from the retained material under any manufacturing or operating conditions whatsoever.

This object is achieved by means of the invention as it is characterized in the claims.

The bore extending as far as the edge of the rim of the slide plate results in extensive replacement of the refractory material such that liquid metal can no longer penetrate into the cracks or the like. Above all, there is a reliable join between the introduced refractory casting mass and the retained refractory material, which join cannot then be impaired when the usual hot shrinkage of approximately 0.5% of the refractory material occurs. This is due to the fact that the essentially smaller particles of the refractory casting mass, together with the casting liquid, which the retained refractory material attempts to absorb, can penetrate into the open pores of the retained refractory material. This results in the introduced casting mass being anchored in the outer layer of the retained refractory material. For this purpose it is again important that there are a sufficient number of pores for the penetration of the fine particles of the refractory casting mass. By means of the boring process the retained material is cut at the bore wall so that even pores, which are normally closed, face the refractory casting mass, to be introduced later, by means of their openings and can absorb the casting mass with its correspondingly fine particles. The anchoring, caused thereby, in the outer area of the retained refractory material results, during burning, in the refractory casting mass shrinking towards the bore wall, but not to the central, released passage opening. Therefore, even during longer operating times, there is no risk of the introduced and consolidated casting mass becoming detached.

The solidifying of the casting mass results in a volume of open pores with a porosity of approximately 10% in particular by means of vibrations. This process assists the penetration, already favoured by the casting flow, of the fine particles of the casting mass into the pores of the retained substance of the slide plates.

Consolidation of the refractory casting mass sometimes takes place hydraulically, sometimes ceramically, whilst it has components which can be consolidated both hydraulically and ceramically. These can be Portland cement and high-alumina cement, but can also be high-alumina cement alone. The proportion of the above cement is chosen in such a way that the casting properties are retained and so that it makes 7% added water in the overall mixture necessary.

Thus it is also possible, in the interest of particularly effective fire-resistance of the casting mass, to bring the total high alumina proportion therein up to more than 90%.

The result of the invention may be substantially improved if a ring, in a prefabricated state, made of highly aluminous refractory material and adjacent the passage opening, is inserted on the side of the slide plate facing the metallurgical container in such a way that the area between the ring and the retained refractory material of the slide plate is filled up with the refractory casting mass.

The bore to be made in the used slide plate has a considerable diameter of approximately 200 mm.

It is, therefore, advantageous to form the above-mentioned bore as a core bore, a hollow bore head, known per se being used.

After the above-mentioned bore has been made, there is a cylindrical opening in the slide plate. By undercutting the cylindrical opening, anchoring of the refractory casting mass is further improved.

Since, on the one hand, it depends on a precise dimensioning of the passage opening in the slide plate, and since the position of the passage opening inside the rim of the slide plate is predetermined, it is advantageous to put a cardboard sleeve at the place of the intended passage opening into the bored-out opening in the slide plate. If the sleeve is made of absorbent cardboard, a particularly smooth inside wall of the refractory casting mass is, at the same time, obtained. The cardboard sleeve inserted centrally with respect to the axis of the discharge opening can, on the one hand, centre the prefabricated ring, whilst, on the other hand, it establishes the further shape of the passage opening outside the inserted ring, when casting with the casting mass.

After introducing and solidifying the refractory casting mass, the slide plate, thus far re-made, firstly undergoes hardening in air at room temperature for approximately 12 hours.

Only then is it dried again at approximately 250° C. and finally during operation is ceramically consolidated.

Figure 2:
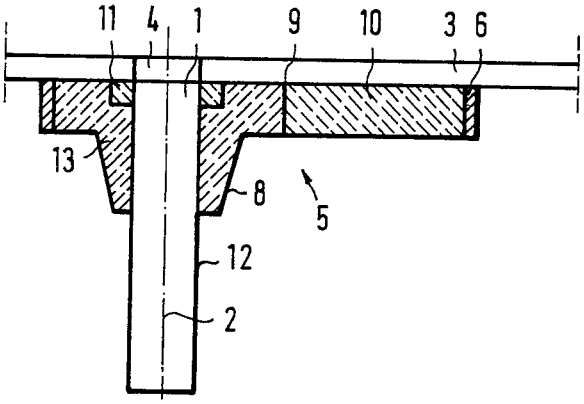

In order to illustrate the method according to the invention, reference is made to the drawings, which are by way of example, wherein:

FIG. 1 shows a plan view of a slide plate to be repaired, as a schematic view and FIG. 2 shows a partial schematic longitudinal section through a repaired slide plate.

The slide plate 5, shown in both Figures, has an oval cross-section and is displaceable in the direction of its longitudinal axis between two positions. In the diagrammatically represented position, its passage opening 1 is aligned with the outlet opening 4 in the base 3 of the metallurgical container, so that, for example, liquid steel can be discharged. The axis of the passage opening 1 coincides with the axis 2 of the outlet opening. When the stream of fluid metal is to be blocked, the slide plate is displaced to the left, so that the outlet opening 4 is covered by the refractory material of the slide plate.

After a certain operating time, radial cracks 7 occur, which extend as far as the edge of the rim 6 and are also often branched. The further they extend away from the passage opening 1, the smaller the gaps caused by them, so that, for example, the right-hand part of the slide plate 5 can still be used for closing, whereas the erosion in the area of the passage opening in the left-hand part of the slide plate is so advanced that accurate casting is no longer possible.

According to the invention, in this state a part of the slide plate 5 extending as far as the edge 6 is bored out concentrically with respect to the passage opening 1. This produces a cylindrical opening corresponding to the circular line 9, the rest of the refractory material 10 being retained.

The slide plate, which has been removed for the purpose of repairs, is placed with its upper side facing downwards on a flat underlayer, the projection, in the shape of a funnel 8, being directed upwards. Then the ring 11 is centred with respect to the rim 6 by means of the cardboard sleeve 12 and is held in this position. As a result of this the refractory casting mass 13 can be cast into the space between the ring 11 and retained refractory material 10 or the rim 6. A detachable mould makes it further possible also to fill up the funnel 8. This mould is removed subsequent to hardening the casting mass.

Solidifying of the casting mass by means of vibration takes place directly after the refractory casting mass 13 has been poured in. Subsequently the slide plate, thus far repaired is further treated in the above described manner and is finally secured back on the base 3 of the metallurgical container.

The percentages given in the above description, inasfar as they denote the pore volume, relate to percent by volume. Otherwise the percentages are percent by weight.

According to the invention, the grain structure of the refractory casting mass and the pore size of the retained refractory material correspond advantageously in that the refractory casting mass has predominantly grain diameters less than $\frac{3}{4}$ the average pore diameter of the retained material. Thus in the case of the retained refractory material in a tarred and tempered state, there results a proportion of 6 to 11% open pores, in which the average pore diameter is approximately 30$\mu$. The refractory casting mass then has a grain structure, in the case of which there are predominantly grain diameters of less than 14$\mu$.

We claim:

1. A method for repairing lower and upper slide plates of closures in metallurgical containers, in particular in casting ladles and intermediate containers for continuous casting, the slide plate able to release a stream of liquid metal by means of a passage opening or interrupting it by means of a closed section, according to its position, and undergoing damage, in particular erosion and radial cracks, originating at its passage opening, in which method a bore is made in the area of the opening of the slide plate concentrically with respect to its passage opening, and when the passage opening is released, a refractory casting mass is poured directly without intervening materials into the bore and is solidified therein, wherein the bore, which is concentric with respect to the passage opening, as far as the edge of the rim of the slide plate, and wherein the grain sizes of the solid bodies of the refractory casting mass are predominantly smaller than the average cross-sectional pore sizes of the retained refractory material of the slide plate.

2. The method according to claim 1, wherein solidifying is carried out until there is open porosity of approximately 10%.

3. The method according to claim 2, wherein the casting mass is solidified by means of vibration.

4. The method according to claim 1, wherein the refractory casting mass has components, which can be consolidated both hydraulically and ceramically, selected from the group consisting of Portland cement and highalumina cement, in proportions which, when maintaining the casting properties, require added water of approximately 7% with respect to the overall mixture.

5. The method according to claim 1, wherein the bore in the slide plate is formed as a core bore.

6. The method according to claim 1, wherein the bore wall is undercut before pouring in the refractory casting mass.

7. The method according to claim 1, wherein a cardboard sleeve made of absorbent cardboard is inserted into the bored-out opening of the slide plate centrally with respect to the axis of the outlet opening of the slide plate, which on the one hand, centres the ring and, on the other hand, is filled with the refractory casting mass.

8. The method according to claim 1, wherein the refractory casting mass, which has been poured into the slide plate and solidified, firstly undergoes hardening in air at room temperature for approximately 12 hours then subjected to drying at approximately 250° C., and undergoes ceramic consolidation during the operation.

9. A method for repairing lower and upper slide plates of closures in metallurgical containers, in particular in casting ladles and intermediate containers for continuous casting, the slide plate able to release a stream of liquid metal by means of a passage opening or interrupting it by means of a closed section, according to its position, and undergoing damage, in particular erosion and radial cracks, originating at its passage opening, in which method a bore is made in the area of the opening of the slide plate concentrically with respect to its passage opening, and when the passage opening is released, a refractory casting mass is poured directly into the bore and is solidified therein, wherein the improvement comprises making the bore, which is concentric with respect to the passage opening, as far as the edge of the rim of the slide plate, and wherein the grain structure of the refractory casting mass has grain diameters which are predominantly less than one-fourth the average pore diameter of the retained refractory material.

10. A method for repairing lower and upper slide plates of closures in metallurgical containers, in particular in casting ladles and intermediate containers for continous casting, the slide plate able to release a stream of liquid metal by means of a passage opening or interrupting it by means of a closed section, according to its position, and undergoing damage, in particular erosion and radial cracks, originating at its passage opening, in which method a bore is made in the area of the opening of the slide plate concentrically with respect to its passage opening, and when the passage opening is released, a refractory casting mass is poured directly into the bore and is solidified therein, wherein the improvement comprises making the bore, which is concentric with respect to the passage opening, as far as the edge of the rim of the slide plate, and wherein the grain sizes of the solid bodies of the refractory casting mass are predominantly smaller than the average cross-sectional pore sizes of the retained refractory material of the slide plate and inserting on the side of the slide plate facing the metallurgical container a ring which is in a prefabricated state, said ring being high aluminous refractory material and adjacent the passage opening, and filling the area between the ring and the retained refractory material of the slide plate with the refractory casting mass.

* * * * *